US005992059A

United States Patent [19]

Bettenga et al.

[11] Patent Number: 5,992,059

[45] **Date of Patent: *Nov. 30, 1999**

[54] TREAD INSERT FOR INSERTION INTO A SHOE SOLE

[75] Inventors: Timothy J. Bettenga, Plymouth, Minn.; Hans Huijbers, Eden Prairie, Netherlands

[73] Assignee: Maven Golf Products LLC, Maple Grove, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/561,543

[22] Filed: Nov. 22, 1995

[51] Int. Cl.[6] ..... A43B 5/00; A43B 23/28

[52] U.S. Cl. ..... 36/134; 36/59 R

[58] Field of Search ..... 36/127, 134, 59 R, 36/67 D

[56] References Cited

U.S. PATENT DOCUMENTS

| | | | |
|---|---|---|---|
| 2,758,396 | 8/1956 | Edwards | 36/67 D |
| 3,413,737 | 12/1968 | Kneebusch | 36/67 D |
| 3,583,082 | 6/1971 | Jordan, Jr. | 36/134 |
| 3,656,245 | 4/1972 | Wilson | 36/67 D |
| 4,014,114 | 3/1977 | Jordan et al. | 36/67 D |
| 4,299,038 | 11/1981 | Epple | 36/67 D |
| 4,366,632 | 1/1983 | Bente | 36/134 X |
| 4,466,205 | 8/1984 | Corbari | 36/134 |
| 4,723,366 | 2/1988 | Hagger | 36/134 |
| 5,029,405 | 7/1991 | De Haitre | 36/134 |
| 5,201,126 | 4/1993 | Tanel | 36/134 |
| 5,259,129 | 11/1993 | Deacon et al. | 36/127 |
| 5,367,793 | 11/1994 | Deacon et al. | 36/127 |

FOREIGN PATENT DOCUMENTS

| | | |
|---|---|---|
| 31 12378 A1 | 10/1982 | Germany . |
| 2814 | of 1913 | United Kingdom . |

*Primary Examiner*—B. Dayoan

*Attorney, Agent, or Firm*—Westman, Champlin & Kelly, P.A.

[57] ABSTRACT

A tread is inserted into a shoe sole. The tread includes a base portion having a periphery and an interior portion within the periphery. A stem portion extends away from a first side of the base portion and is connectable to the shoe sole. A projection portion is disposed generally at the periphery of the base portion and extends away from a second side of the base portion.

19 Claims, 6 Drawing Sheets

TREAD INSERT FOR INSERTION INTO A SHOE SOLE

BACKGROUND OF THE INVENTION

The present invention deals with shoe treads. More specifically, the present invention deals with a removable tread connectable to the sole of a shoe.

The game of golf has been very popular for many years and has gained significant popularity in recent years. This is specifically true with respect to women golfers.

Conventional golf shoes include a sole, the exterior portion of which has a plurality of threaded apertures therein. The apertures are threaded to receive removable golf spikes. Traditional removable golf spikes have a circular skirt with a threaded stem extending away from the skirt in one direction, and a metal cleat extending away from the skirt in the opposite direction. The threaded stem is threadable into the threaded apertures in the shoe sole such that, when the golfer wears the shoe, the projecting metal spike is in engagement with the ground or turf.

In temperate climates, golf courses are open all year round. Such courses are typically seeded with one type of grass that grows during the summer, and is dormant during the winter months, and another type of grass which grows during the winter months. For example, many courses are planted with Bermuda grass which grows during the summer months and goes dormant in the winter. Then, in the winter months, the golf course is overseeded with rye grass which grows during the winter months, and then dies.

Walking on the dormant grass with the conventional metal golf spikes can be highly detrimental to the dormant grass, and therefore detrimental to the condition of the course. Also, many golf courses, both public and private, have decided that the conventional metal golf spikes cause an undesirable amount of damage to both the fairways and greens, even on courses which are only open during one season, or on courses on which play is not allowed when the grass is dormant. Therefore, many golf courses no longer allow conventional metal golf spikes to be used at all.

In an effort to provide alternative spikes which do not damage the golf course, others have attempted to provide "spikeless" golf treads for use with golf shoes. For example, the Deacon et al. U.S. Pat. Nos. 5,259,129 and 5,367,793 show a skirt which has a threaded stem extending from one surface of the skirt. A plurality of radially, outwardly extending ridges are also provided, and extend from a second side of the skirt. The radially extending ribs purportedly provide some amount of traction, over and above flat shoes, but do not damage the course as much as conventional metal golf spikes.

However, the treads discussed in the Deacon et al. patents suffer from at least one significant drawback. Applicants have found that the radially extending ribs define channels which tend to catch and trap mud and other debris therebetween. When the debris fills in the area between the ribs, the traction-providing capacity of the treads is significantly diminished.

Also, traditional spikes, such as those shown in the Deacon et al. patents, are formed with the skirt portion being concave against the shoe sole. Such a surface is undesirably sensitive to unevenness and wear.

SUMMARY OF THE INVENTION

A tread is insertable into a shoe sole. The tread includes a base portion having a periphery and an interior portion within the periphery. A stem portion extends away from a first side of the base portion and is connectable to the shoe sole. A projection portion is disposed generally at the periphery of the base portion and extends away from a second side of the base portion.

DETAILED DESCRIPTION OF THE PREFERRED EMBODIMENTS

Figure 1A:
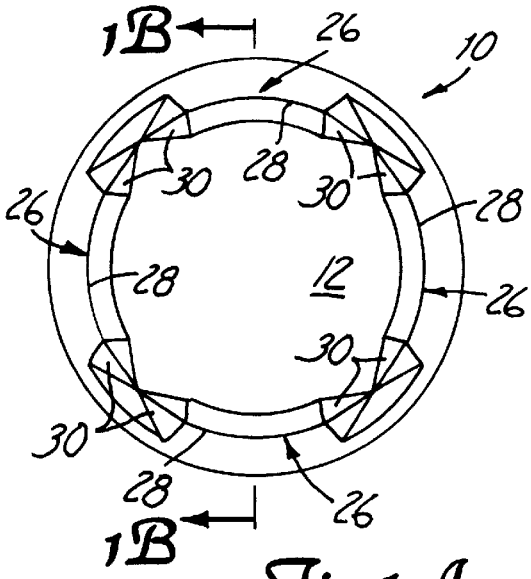
FIG. 1A is a top plan view of a first embodiment of a tread according to present invention.
Figure 1B:
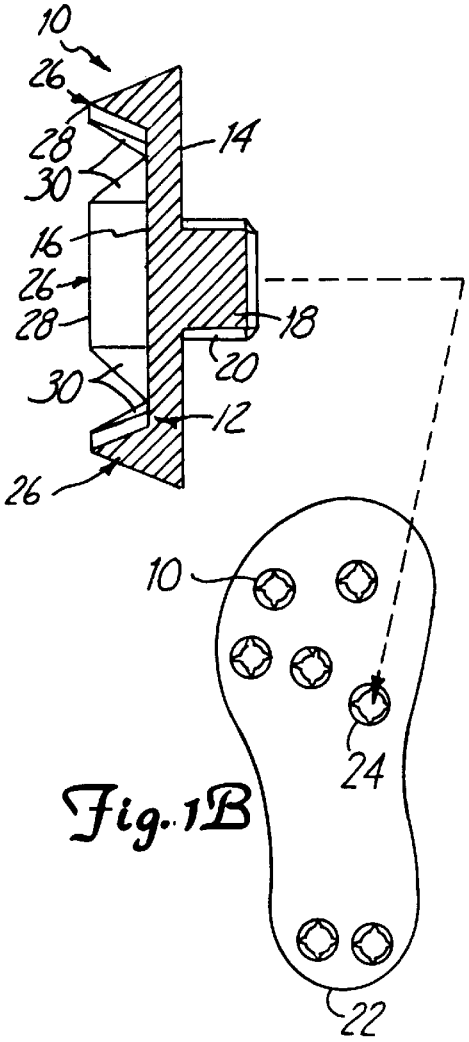
FIG. 1B is a side sectional view of the tread shown in FIG. 1A, and taken along second lines 1B—1B.

FIG. 1A is a top plan view of one preferred embodiment of a tread 10 according to the present invention. FIG. 1B is a side sectional view of tread 10 taken along section lines 1B—1B in FIG. 1A. Tread 10 includes, in the preferred embodiment, a generally circular base portion 12. Base portion 12 has a first side 14 and a second side 16. A stem portion 18 extends away from the first side 14. Stem portion 18 has a threaded outer periphery 20. FIG. 1B also shows the sole portion of a golf shoe 22. Golf shoe 22 is shown with a plurality of spikes 10 engaged therewith. Shoe 22 also shows a threaded aperture 24. Stem portion 18 is threadably engageable within threaded aperture 24 to secure tread 10 in the sole of shoe 22.

Tread 10 also has a plurality of extension portions 26. Extension portions 26 extend away from second surface 16 of base portion 12. Extension portions 26 are relatively shallow as distinguished from prior spikes to provide a "spikeless" tread for traction which does not damage grass or other surfaces, such as a building floor. While there may be any number of extension portions 26, the embodiment shown in FIGS. 1A and 1B includes four extension portions.

It is believed that a number between three and six extension portions is preferred.

In the embodiment shown in FIGS. 1A and 1B, extension portions 26 have a ridge portion 28 and end portions 30. End portions 30 are preferably tapered and extend between ridge portion 28 and the second side 16 of base portion 12.

Also, in the preferred embodiment, base portion 12, extension portions 26 and stem portion 18, are all integrally formed with one another. In the preferred embodiment, these portions are formed of a suitable, durable polymer material, such as poly block urethane, polyester, or other suitable material. It should also be noted that these portions can be separately formed and assembled together in order to form the desired tread. However, in the preferred embodiment, they are molded, or otherwise formed, integrally with one another.

Figure 2A:
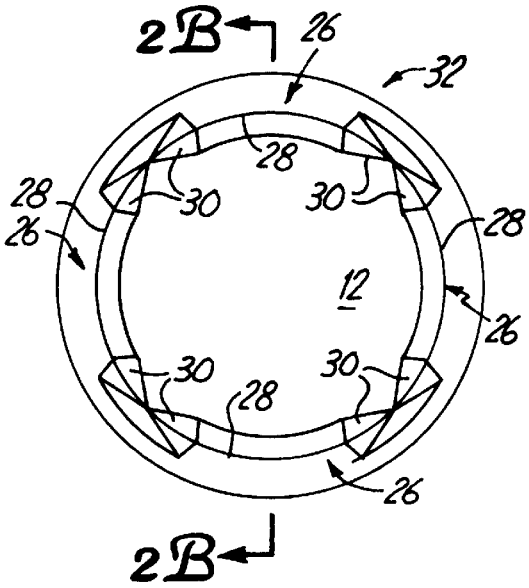
FIG. 2A is a top plan view of a first embodiment of a tread according to present invention.
Figure 2B:
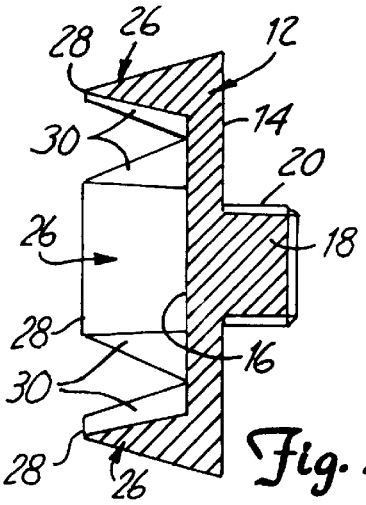
FIG. 2B is a side sectional view of the tread shown in FIG. 2A, and taken along second lines 2B—2B.

FIG. 2A is a top plan view of another embodiment of a tread 32 according to the present invention. FIG. 2B is a side sectional view of tread 32 taken along section lines 2B—2B in FIG. 2A. A number of items are similar to those shown in FIGS. 1A and 1B and similar items are similarly numbered. The difference between tread 10 and tread 32 is that the extension portions 26 extend further from second side 16 of base portion 12 in tread 32 than they do in tread 10. For instance, in the embodiment shown in FIG. 1B, the total height of extension portions 26 (from side 14 of base portion 12 to ridge portion 28, is preferably approximately one-quarter of the diameter of base portion 12 of tread 10. The extension portions 26 in FIGS. 2A and 2B extend away from the base portion 12 by a distance of approximately one-third of the diameter of base portion 12. While the present invention is contemplated to cover any reasonable dimension, these two dimensions are simply shown to illustrate that many dimensions are useable.

Figure 3A:
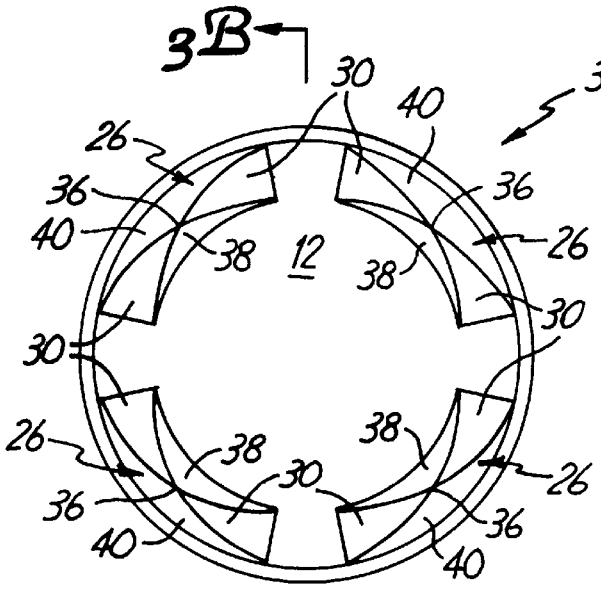
FIG. 3A is a top plan view of a first embodiment of a tread according to present invention.
Figure 3B:
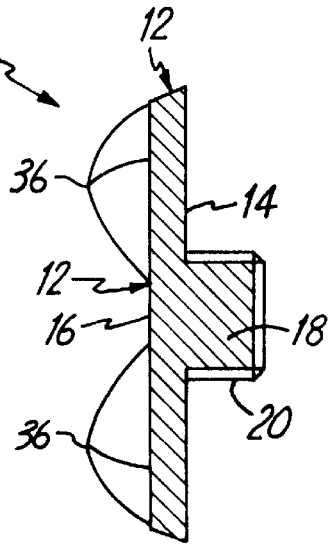
FIG. 3B is a side sectional view of the tread shown in FIG. 3A, and taken along second lines 3B—3B.

FIGS. 3A and 3B show a top plan view, and a side sectional view, respectively, of a third embodiment of a tread 34 according to the present invention. Similar items are similarly numbered to those shown in FIGS. 1A–2B. The tapered sections 30, in the embodiment shown in FIGS. 3A and 3B, extend substantially to a pinnacle 36. Also, extension members 26 in FIGS. 3A and 3B have inner and outer tapered sections 38 and 40 which extend between base portion 12 and pinnacle 36. Thus, extension portions 26 substantially form pyramid-shaped sections which are spaced from one another about the periphery of base portion 12.

Figure 4A:
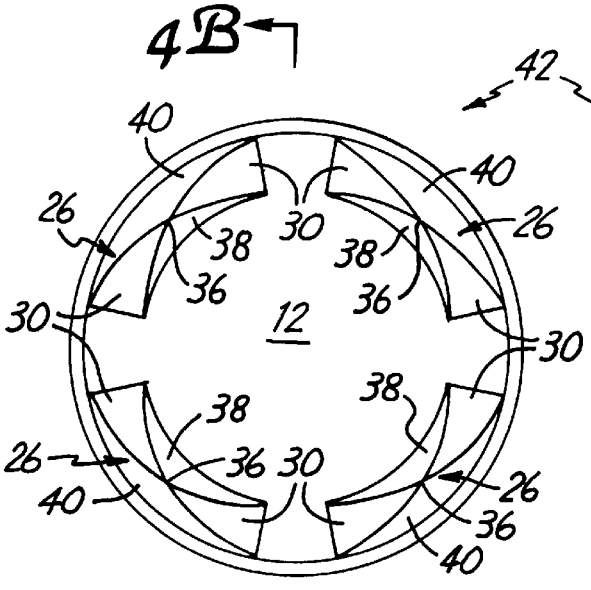
FIG. 4A is a top plan view of a first embodiment of a tread according to present invention.
Figure 4B:
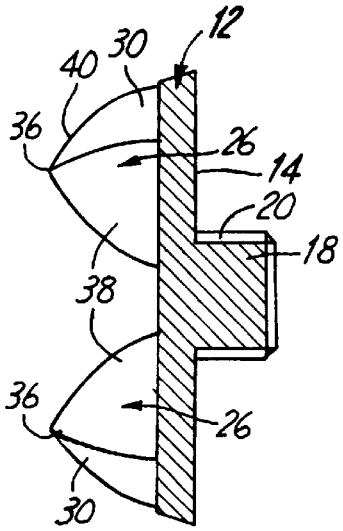
FIG. 4B is a side sectional view of the tread shown in FIG. 4A, and taken along second lines 4B—4B.

FIGS. 4A and 4B show another embodiment of a tread 42 according to the present invention. Tread 42 is highly similar to tread 34 shown in FIGS. 3A and 3B, except that FIGS. 4A and 4B illustrate a different height-to-diameter ratio for tread 42 than that shown for tread 34. FIGS. 4A and 4B are simply provided to illustrate that a large variety of height-to-diameter ratios are contemplated by the present invention.

Figure 5A:
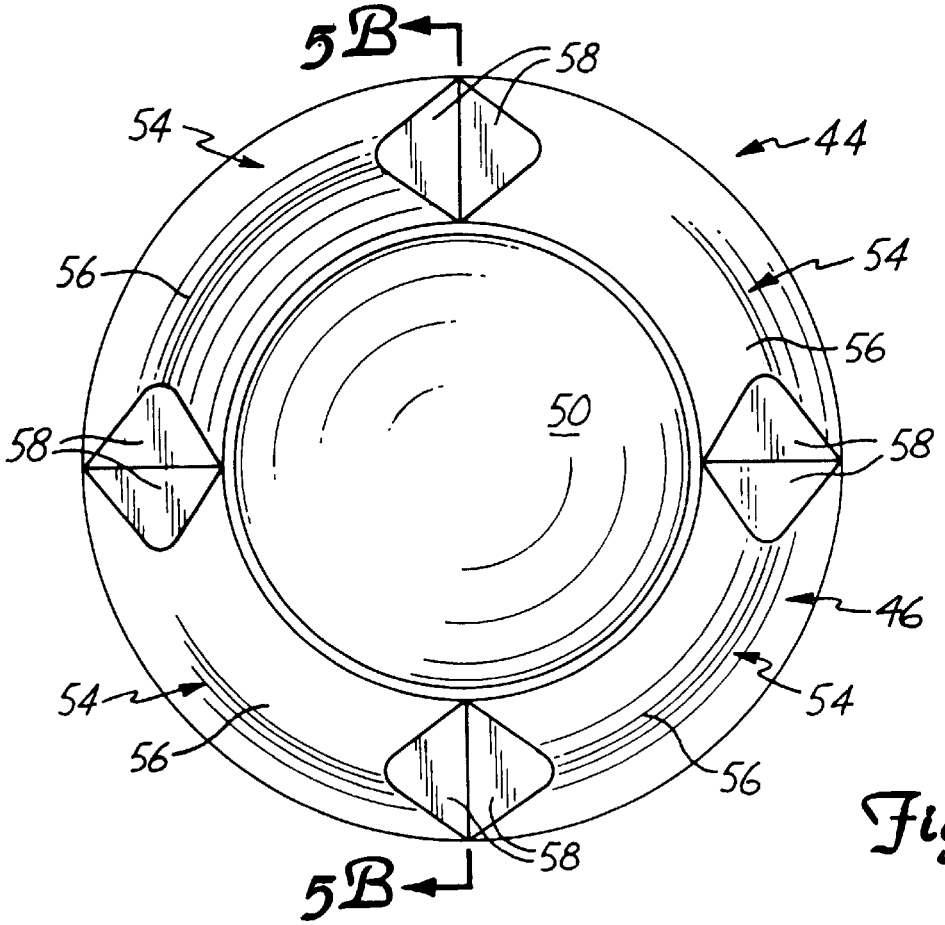
FIG. 5A is a top plan view of a first embodiment of a tread according to present invention.
Figure 5B:
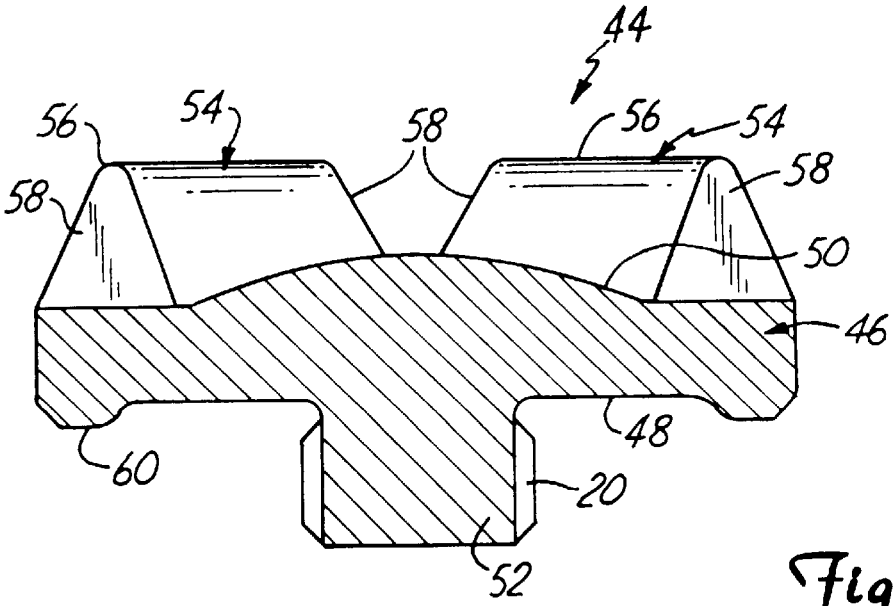
FIG. 5B is a side sectional view of the tread shown in FIG. 5A, and taken along second lines 5B—5B.

FIGS. 5A and 5B are a top plan view, and side sectional view, respectively, of another embodiment of a tread 44 according to the present invention. Tread 44 includes a base portion 46 having a first side 48 and a second side 50, a stem portion 52 and extension portions 54. As with the previous embodiments, stem portion 52 extends away from first side 48 of base portion 46 and has a threaded outer periphery 20. Extension portions 54 extend away from second side 50 of base portion 46. In the embodiment shown in FIGS. 5A and 5B, extension portions 54 are generally triangular in cross-section terminating at an upper curved ridge portion 56. Also, tapered end sections 58 extend between the first side 50 of base portion 56 and the curved ridge portions 56. Therefore, extension portions 54 form generally annular ridge sections spaced by gaps formed by generally opposing tapered end sections 58.

In addition, the first side 50 of base portion 46 is formed, at approximately its center, in a generally convex shape extending outwardly away from base portion 46. It is believed that such a shape significantly reduces the build-up of, or adherence of, mud and other debris on tread 44.

Tread 44 also has an extension portion 60 extending from the first side 48 of tread 44. In the embodiment shown in FIG. 5B, extension member 60 is a continuous annular ridge or ring formed about the periphery of base portion 46. Ridge 60 is a shoe-contacting ridge which engages the sole of the shoe into which tread 44 is inserted. This provides a significantly greater amount of stability than traditional metal spikes which were formed with simply a concave skirt positioned in facing relation to the shoe sole. It should also be noted, however, that extension portion 60 could be formed as a plurality of generally annular ridge portions, or other discontinuous configurations which engage the shoe sole.

Figure 6A:
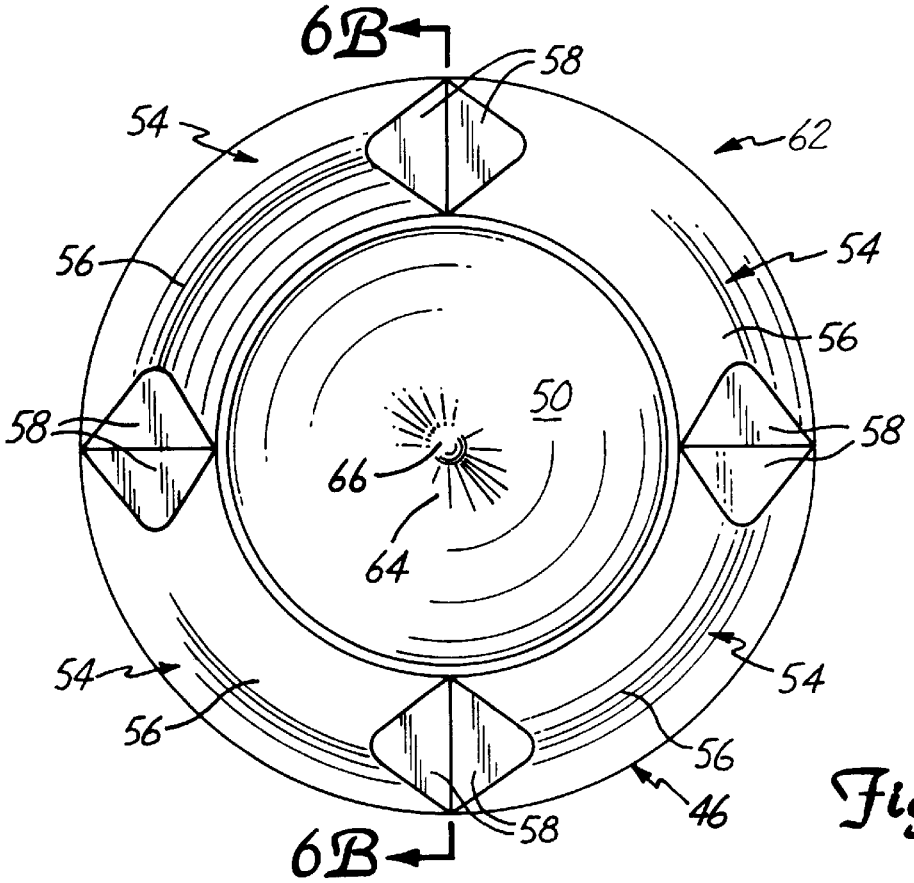
FIG. 6A is a top plan view of a first embodiment of a tread according to present invention.
Figure 6B:
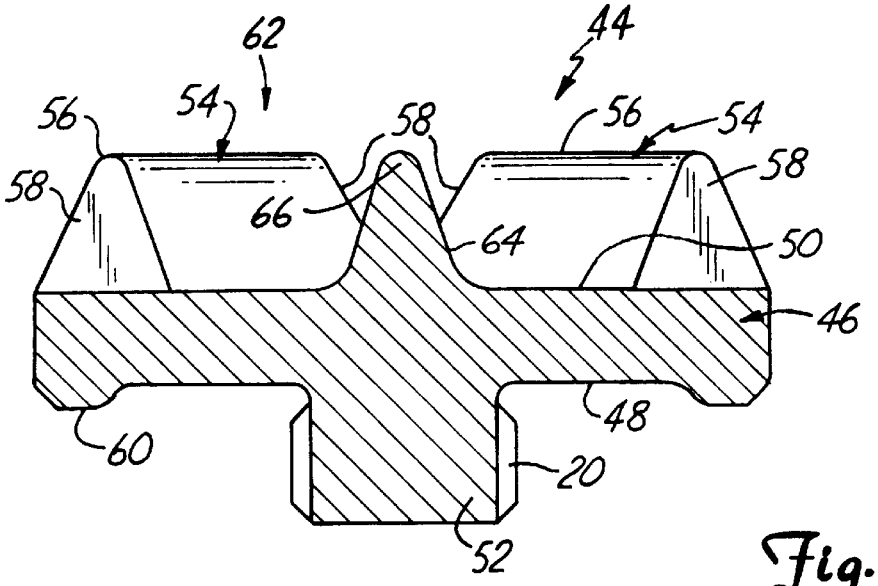
FIG. 6B is a side sectional view of the tread shown in FIG. 6A, and taken along second lines 6B—6B.

FIGS. 6A and 6B show a top plan view, and side sectional view taken along section lines 6B—6B, respectively, of another embodiment of a tread 62. Tread 62 is similar to tread 44 shown in FIGS. 5A and 5B and similar items are similarly numbered. However, the surface on second side 50 of base portion 46 is shaped differently than that of tread 44. Rather than having a gentle concave surface, or one which extends substantially from the periphery of base 46 to its center, the surface defining side 50 of tread 62 is substantially flat throughout base portion 46 except generally at the center of side 50. At that point, side 50 rises to a substantially cone-shaped surface 64 and terminates in a generally curved upper tip portion 66.

Figure 7A:
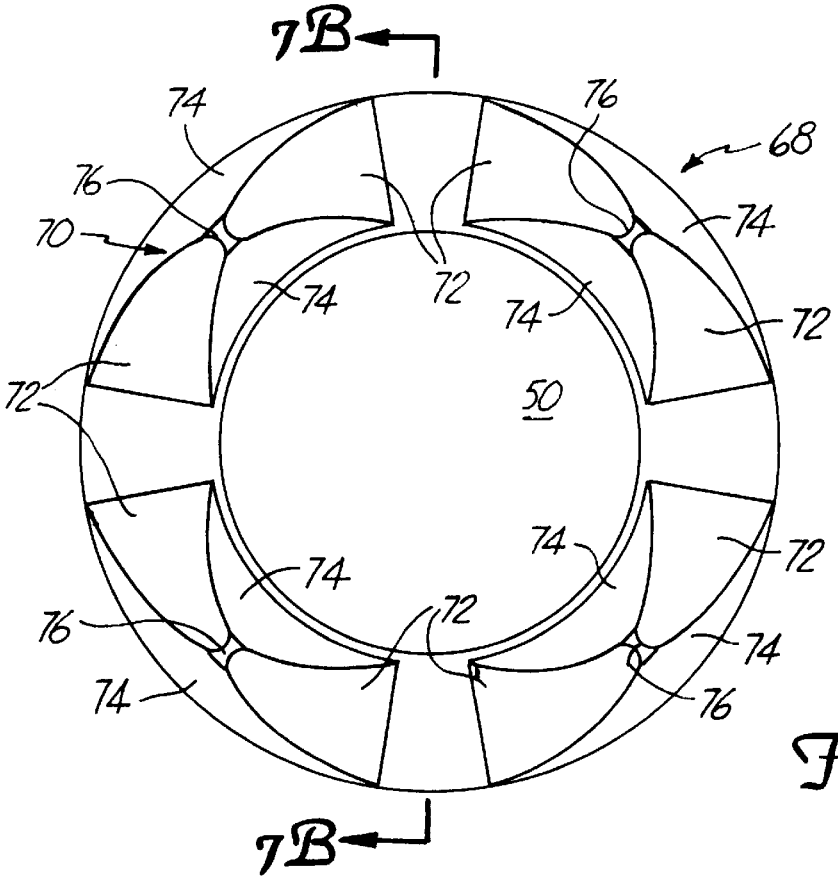
FIG. 7A is a top plan view of a first embodiment of a tread according to present invention.
Figure 7B:
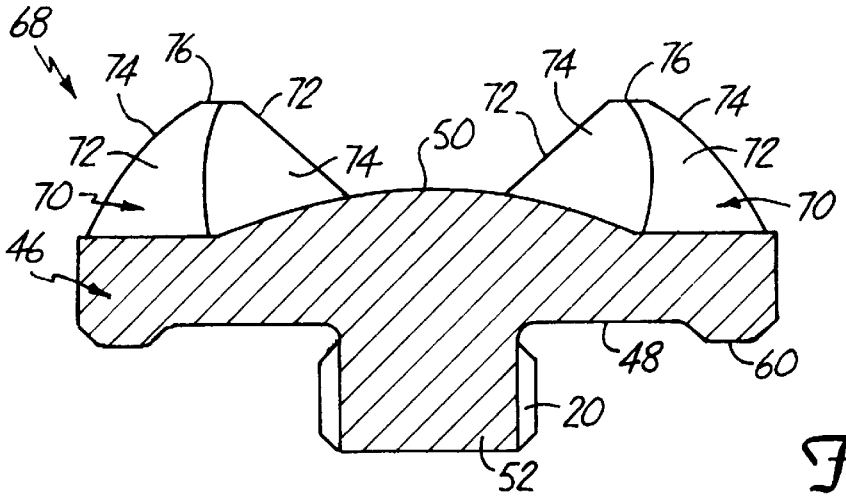
FIG. 7B is a side sectional view of the tread shown in FIG. 7A, and taken along second lines 7B—7B.

FIGS. 7A and 7B show another embodiment of a tread 68 according to the present invention. FIG. 7A is a top plan view and FIG. 7B is a side sectional view taken along section lines 7B—7B in FIG. 7A. Tread 68 is similar to tread 44 shown in FIGS. 5A and 5B, and similar items are similarly numbered. However, tread 68 is provided with different extension portions 70 than is tread 44. Extension portions 70 have tapered end sections 72 and generally opposed tapered side sections 74 which all terminate in a pinnacle region 76. Thus, extension portions 70 generally form pyramids disposed about the periphery of base portion 46.

Figure 8A:
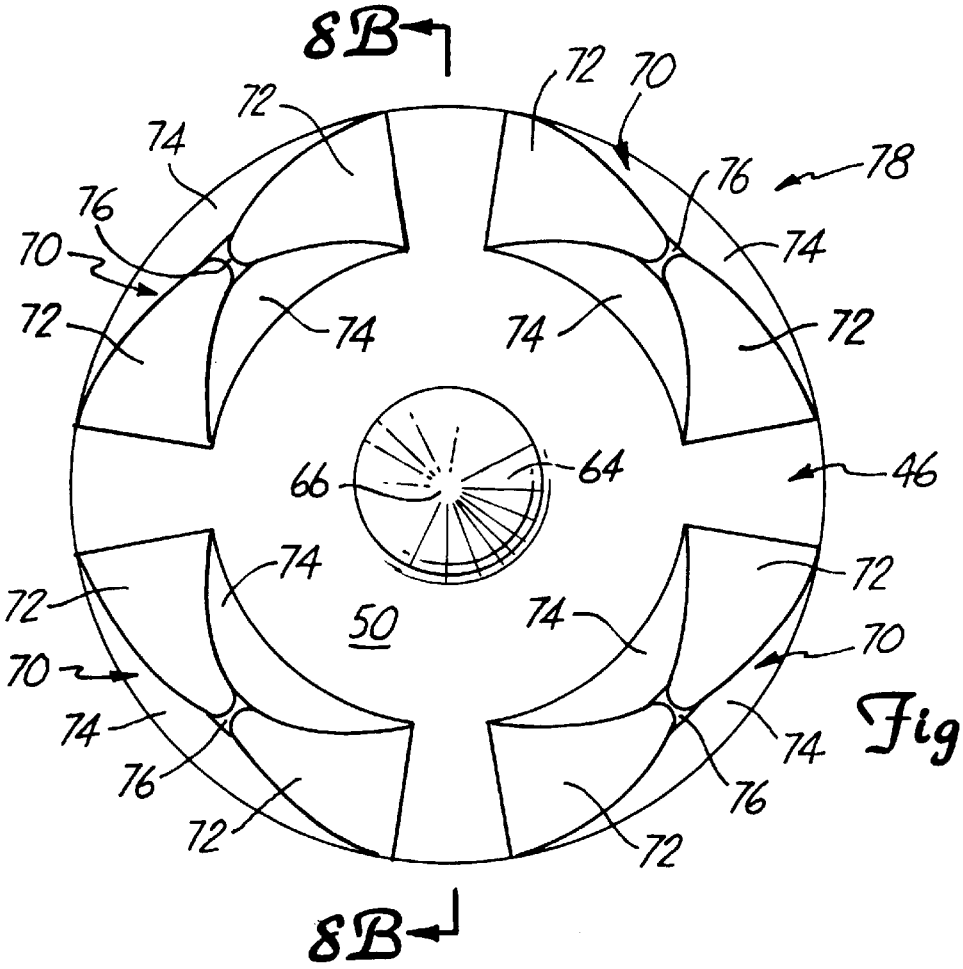
FIG. 8A is a top plan view of a first embodiment of a tread according to present invention.
Figure 8B:
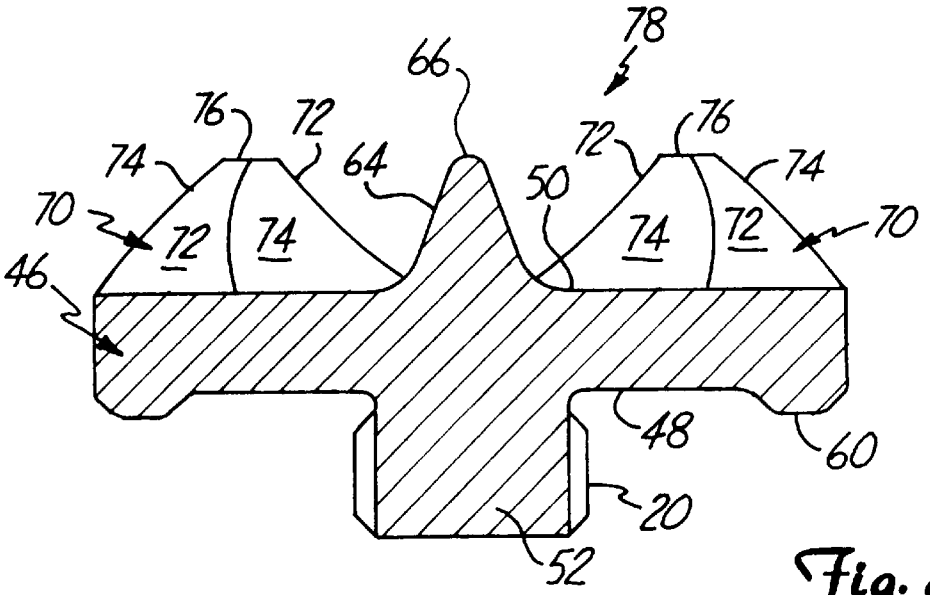
FIG. 8B is a side sectional view of the tread shown in FIG. 8A, and taken along second lines 8B—8B.

FIGS. 8A and 8B show another embodiment of a tread 78 according to the present invention. FIG. 8A is a top plan view, and FIG. 8B is a side sectional view taken along section lines 8B—8B in FIG. 8A. Tread 78 is similar to tread 62 shown in FIGS. 6A and 6B. However, rather than having projection portions 54, tread 78 has projection portions 70, similar to those shown in FIGS. 7A and 7B. Thus, projection portions 70 perform substantially pyramid-shape projections disposed about the periphery of base portion 46.

It should also be noted that treads according to the present invention may also be provided with suitable apertures for receiving tangs which extend from a conventional spike wrench. The tangs are inserted within the apertures and used in tightening the spikes in the shoe sole. Further, the tangs of the spike wrench may also be placed between extension portions according to the present invention and used in tightening the treads. Engagement between the tangs of the spike wrench and the spaces between extension portions according to the present invention can also be used in tightening the treads to the shoe sole.

Therefore, the present invention provides a tread insertable into an aperture in a shoe sole which has a base portion and one or more extension portions. The extension portions are proximate the periphery of the base portion and extend away from the base portion. One embodiment of the present invention also provides a contoured inner portion which is in the interior of the periphery of the base portion. This is believed to result in less build-up of mud and debris in the tread. Further, in yet another feature of the present invention, an extension portion is also provided which extends toward the shoe sole. This results in greater stability in the tread.

Although the present invention has been described with reference to preferred embodiments, workers skilled in the art will recognize that changes may be made in form and detail without departing from the spirit and scope of the invention.

What is claimed is:

1. A tread insert adapted for insertion into a shoe sole, the tread insert comprising:

a base portion having first and second sides;

a stem portion extending from the first side of the base portion and adapted for connection to a shoe sole; and a tread portion extending from the second side of the base portion and including a central position, the tread portion being formed of four relatively blunt spaced tread projections, each tread projection being formed of an elongated curve-shaped element and spaced about a periphery portion of the base portion having an upper elongated ridge portion defining a crest of the tread projection, said tread projection being formed of sloped sides extending to the crest of the tread projection, the tread projection extending from the second side of the base, and concentrically arranged about the central position.

2. The tread insert of claim 1 wherein the crest is rounded.

3. A tread insert for insertion into a shoe sole, the tread insert comprising:

a base portion having a periphery and an interior portion within the periphery;

a stem portion extending away from a first side of the base portion and connectable to the shoe sole; and a tread portion supported by a second side of the base portion including a plurality of spaced relatively blunt tread projections disposed proximate the periphery of the base portion and extending away from a second side of the base portion to a tread plane, the tread projections being formed of generally elongated curve-shaped elements concentrically arranged about a central position of the tread portion separated by tread openings between each tread projection, the tread portion including an opened central portion opened to each of the tread openings.

4. The tread insert of claim 3 wherein the interior portion of the second side of the base portion is dome shaped.

5. The tread insert of claim 3 wherein the base portion includes a projection portion, spaced from the stem portion and extending away from the first side of the base portion.

6. A tread insert for insertion into a shoe sole, the tread insert comprising:

a base portion having first and second sides, each side having a periphery and an interior portion within the periphery;

the first side of the base portion including:

a stem portion extending away from the first side of the base portion and connectable to the shoe sole, the stem portion having a smaller circumferential diameter than the base portion;

a circular ridge extending from the first side of the base portion about the stem portion; and the second side of the base portion including:

a tread portion supported by the second side of the base portion, comprising a relatively blunt tread projection extending about the periphery of the base portion from the second side of the base portion to a tread plane, the tread projection being formed of at least one elongated curve-shaped element concentrically arranged about a central position of the tread portion said curved shaped element forming sides being sloped to converge at a crest of the tread projection, said tread portion being limited to at least one concentrically-aligned element and excluding elements not contoured to concentrically align with the central position.

7. The tread insert of claim 6, and wherein the tread portion comprises:

a plurality of spaced relatively blunt tread projections extending about the periphery of the base portion and extending away from the second side of base portion, formed of curve-shaped elements concentrically arranged about the central position of the tread portion.

8. The tread insert of claim 7 wherein the plurality of tread projections comprises:

spaced projections wherein sloped sides converge to an elongated ridge forming the crest of the projection.

9. The tread insert of claim 1 wherein the stem portion includes a threaded peripheral surface.

10. The tread insert of claim 6 wherein the circular ridge extending from the first side of the base portion is disposed proximate the periphery of the first side of the base portion.

11. The tread insert of claim 6 wherein the circular ridge and the base portion are integrally formed with one another.

12. The tread insert of claim 6 wherein the tread portion and the base portion are integrally formed with one another.

13. The tread insert of claim 6 wherein the stem portion and the base portion are integrally formed with one another.

14. The tread insert of claim 6 wherein the interior portion includes a planar recessed surface portion.

15. The tread insert of claim 7 wherein the tread projections include four sloped surfaces.

16. The tread insert of claim 7 wherein the tread projections include a plurality of sides, each of said sides being sloped to converge at a crest of the tread projection.

17. The tread insert of claim 7 wherein the tread projections include sloped end surfaces.

18. The tread insert of claim 7 wherein the base is generally circular-shaped and the tread projections are contoured about an outer perimeter of the base portion.

19. The tread insert of claim 8 wherein the ridge is rounded.

* * * * *